US005842934A

United States Patent [19]

Ezaki et al.

[11] Patent Number: 5,842,934

[45] Date of Patent: Dec. 1, 1998

[54] GOLF CLUBHEAD

[75] Inventors: Hiroshi Ezaki, Saitama-ken; Tetsuya Miyajima, Tokyo, both of Japan

[73] Assignee: Bridgestone Sports Co., Ltd., Tokyo, Japan

[21] Appl. No.: 805,137

[22] Filed: Feb. 24, 1997

Related U.S. Application Data

[60] Provisional application No. 60/016,702 May 2, 1996.

[30] Foreign Application Priority Data

Feb. 22, 1996 [JP] Japan ..... 8-060109
Apr. 11, 1996 [JP] Japan ..... 8-114110

[51] Int. Cl.[6] ..... A63B 53/04

[52] U.S. Cl. ..... 473/342; 473/349; 473/350

[58] Field of Search ..... 473/324, 329, 473/332, 342, 349, 350, 345, 346

[56] References Cited

U.S. PATENT DOCUMENTS

| | | | |
|---|---|---|---|
| 3,814,437 | 6/1974 | Winquist | 473/350 |
| 3,858,886 | 1/1975 | Cosby | 473/350 |
| 4,938,470 | 7/1990 | Antonious | 473/350 |
| 5,074,563 | 12/1991 | Gorman | 473/350 |
| 5,346,213 | 9/1994 | Yamada | 473/342 |
| 5,467,983 | 11/1995 | Chen | 473/342 |
| 5,547,194 | 8/1996 | Aizawa | 473/350 |

*Primary Examiner*—Sebastiano Passaniti
*Attorney, Agent, or Firm*—Sughrue, Mion, Zinn, Macpeak & Seas, PLLC

[57] ABSTRACT

The present invention provides a golf clubhead having a head body comprising a face member fitted and secured over an aperture formed in the central area of the head body through the same, and a cavity surrounded by a sole, a toe, a heel and a top blade on a backface of the face member. Wherein the head body comprises a vertical rib extending from the top blade to the sole so as to divide said cavity into a plurality of sections and support the face member and the vertical rib has at the center thereof a means for fastening the face member, and the face member is fastened by the means to the vertical rib.

6 Claims, 6 Drawing Sheets

GOLF CLUBHEAD

CROSS REFERENCE TO RELATED APPLICATIONS

This application is an application filed under 35 U.S.C. §111(a) claiming benefit pursuant to 35 U.S.C. §119(e) (i) of the filing date of the Provisional Application 60/016,702, filed May 2, 1996, pursuant to 35 U.S.C. §111(b) .

BACKGROUND OF THE INVENTION

1. Filed of the Invention

The present invention relates to a golf clubhead having a head body comprising a face member fitted and secured over an aperture formed in the central area of the head body through the same, and a cavity surrounded by a sole, a toe, a heel and a top blade on a backface of the face member.

2. Description of the Prior Art

For better flying directional (horizontal and vertical) stability of a golf ball, golf clubs having a metal head, a so-called "iron club", have been proposed of which the moments of inertia about the vertical and horizontal axes are designed large enough to widen the sweet area of the clubhead. A variety of golf clubheads have been proposed for such purposes. A well-known one is a golf clubhead comprising a head body which has formed in the central area thereof such an aperture formed in the central area of the head body to result in a larger thickness of the circumference of the head body around the aperture as compared with the rest (to dispose the weight), and a face member made of a metal plate having a relatively small specific gravity to be is to be fitted and secured over the aperture in the head body. The head body having such a thick circumference, and the face member are preferentially made of a stainless steel (about 7.8 in specific gravity) and a titanium alloy (about 4.5 in specific gravity), respectively. The thick circumference of the head body around the aperture includes a sole, toe, heel, and top blade. To position the center of gravity as low as possible in the clubhead, the sole is formed thickest while the toe and heel portions are gradually decreased in thickness in a direction from the sole to top blade. The head body has further formed on the face side thereof around the aperture a depression in which the face member is to be fitted along the circumference thereof. The depth of the depression is equal to the thickness of the face member. That is to say, when the face member is fitted and secured in the depression, the front surface of the head body is flush with that of the face member.

This type of clubhead is excellent in dispersion of gravity to the circumference of the head. However, when a golf ball is struck with such clubhead, the face member is vibrated at a portion thereof near the top blade of which the thickness is smallest, which is likely to cause a poor feeling of impact when striking a golf ball.

SUMMARY OF THE INVENTION

Accordingly, the present invention has an object to overcome the above-mentioned drawbacks of the conventional golf clubheads by providing a golf clubhead which can maintain good flying directional stability of a struck ball and excellent feeling of ball hitting impact (reduced vibration of the clubhead).

The above object can be attained by providing a golf clubhead having a head body comprising a face member fitted and secured over an aperture formed in the central area of the head body through the same, and a cavity surrounded by a sole, a toe, a heel and a top blade on a backface of the face member, wherein said head body comprises a vertical rib extending from the top blade to the sole to divide said cavity into a plurality of sections and support said face member and said vertical rib has at the center thereof a means for fastening said face member, and said face member is fastened by said means to said vertical rib.

According to the present invention, the head body comprises a vertical rib extending from the top blade to the sole so as -to divide said cavity into a plurality of sections and support said face member and said vertical rib has at the center thereof a means for fastening said face member, and said face member is fastened by said means to said vertical rib. The provision of the vertical rib and fastening means assures a secure fixation of the face member to the head body, thereby maintaining good flying directional stability of a struck ball, suppressing the vibration of the face member and thus ensuring an improved feeling of ball hitting impact. Because of the secure fixation to the vertical rib, even a thinner face member is less vibrated than a one secured only along the circumference thereof to the head body. A face member made of a material relatively small in specific gravity is excellent in peripheral weight distribution and flying directional stability of a struck ball, and assures a wide sweet area.

BRIEF DESCRIPTION OF THE DRAWINGS

These and other objects and advantages of the present invention will be better understood from the ensuring description made, by way of example, of the preferred embodiments of the present invention with reference to the drawings.

FIG. 8.

DETAILED DESCRIPTION OF THE PREFERRED EMBODIMENTS

Figure 1:
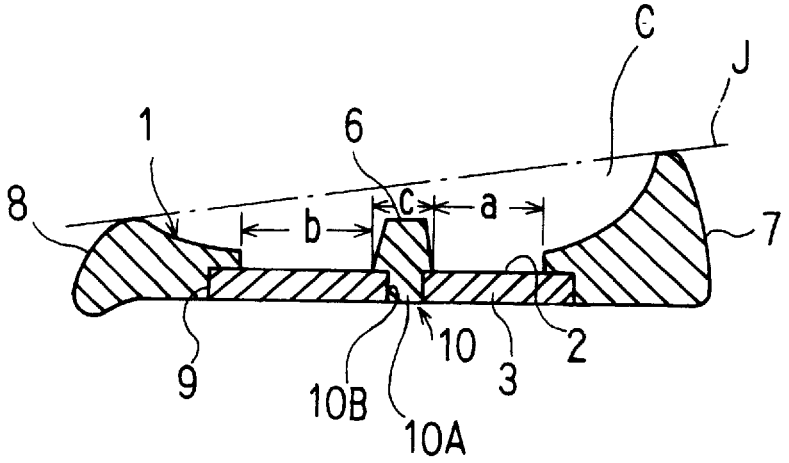
FIG. 1 is a sectional view taken along line A—A in FIG. 2.
Figure 2:
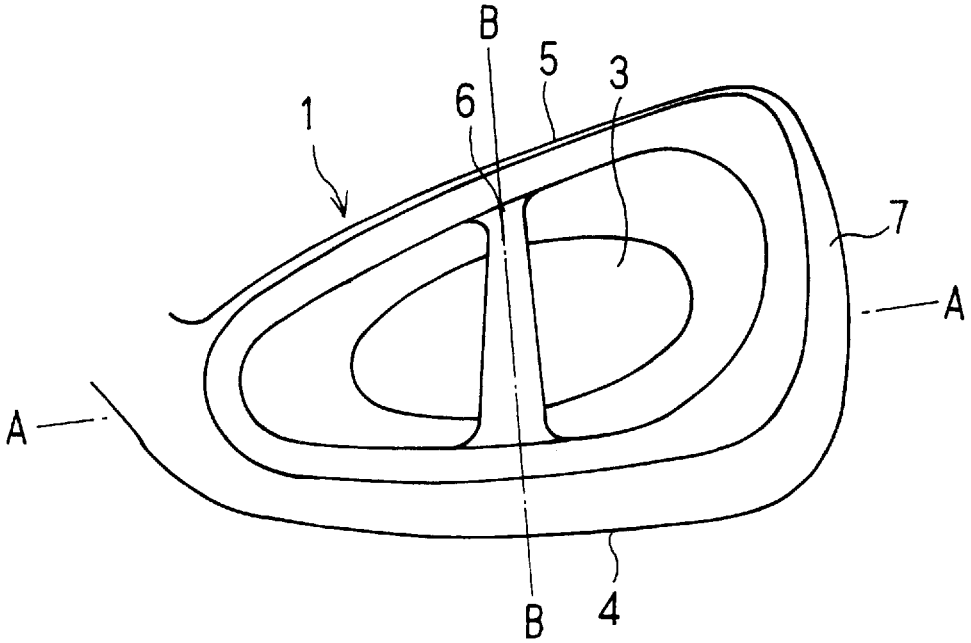
FIG. 2 is a view of the clubhead from the back thereof.
Figure 10:
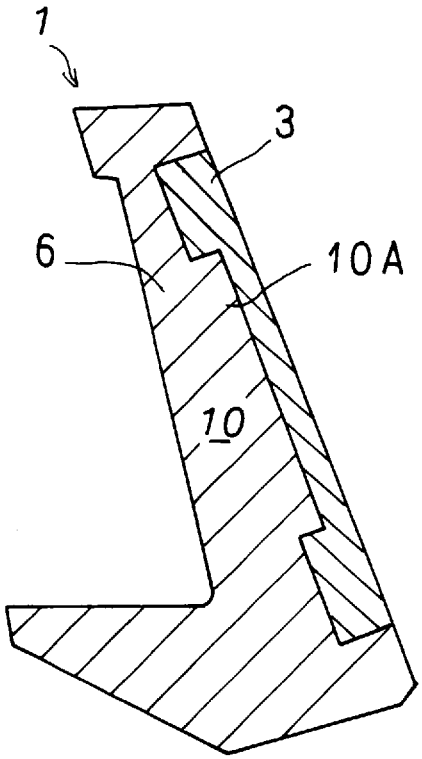
FIG. 10 is a sectional view taken along line B—B in FIG. 2.

Referring now to FIGS. 1,2 and 10 the golf clubhead according to the present invention comprises a head body 1 having formed in the central area thereof an aperture 2 formed in the head body through the clubhead, and a face member 3 fitted and secured over the aperture 2 in the head body 1. The head body 1 further comprises a cavity C surrounded by a sole 4, a toe 7, a heel 8 and a top blade 5 on a backface of the face member 3. The head body 1 has also a vertical rib 6 extending over the cavity C from the top blade 5 to the sole 4 to divide the cavity C into a plurality of sections to support the face member 3. Normally the head body 1 and vertical rib 6 are integrally made of a same material such as a stainless steel or soft iron. The golf clubhead according to this embodiment is an iron having the cavity C formed in the back thereof, a so-called "cavity-back" iron. In this type of golf clubhead, the periphery of the cavity C, that is, the circumference of the head body 1 is designed to be thicker than the rest of the clubhead. The sole 4 is thickest while the portion including the toe 7 and the heel 8 is gradually decreased in thickness as it goes from the sole 4 to the top blade 5. The head body 1 has formed on the face side thereof a depression 9 in which the face member 3 is fitted along the circumference thereof. The depth of the depression 9 is equal to the thickness of the face member 3. That is to say, when the face member 3 is fitted in the depression 9, the front side of the head body is flush with that of the face member 3. The vertical rib 6 has a means 10 of fastening the face member 3 to the vertical rib 6. According to this embodiment, the fastening means 10 comprises a projection 10A formed in the longitudinal center of the vertical rib 6 and which is to be fitted and caulked in a hole 10B formed in the center of the face member 3.

The aperture 2 is divided by the vertical rib 6 into two sections having a width aand b, respectively. The vertical rib 6 has a width c. The relation in width (a:b:c) between the aperture 2 and vertical rib 6 is within a range from 7:7:1 to 1:1:1, and it should preferably be approximately 5:5:1. Also the back of the vertical rib 6 should preferably be short of a line J connecting the toe 7 and heel 8 at the back of the golf clubhead. Preferably it should be 1 to 5 mm short of the line J. The head body 1 and rib 6 may be made of copper or its alloy, iron, stainless steel or the like. Making the head body 1 and face member 3 from different materials will assure a better feeling of impact when striking a golf ball.

The face member 3 should preferably be made of a material having a specific gravity less then that of the material forming the head body 1. For example, titanium alloy, duralumin, etc. may be used as an optimum material for the face member 3.

Figure 3:
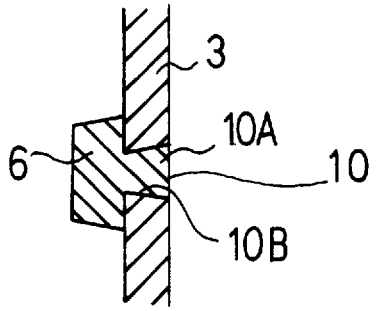
FIG. 3 is a sectional view showing another example of the fastening means.

FIG. 3 shows another example of the fastening means 10. As shown, the projection 10A from the vertical rib 6 is designed to be thicker toward the end thereof. The projection 10A is force-fitted into the hole LOB in the face member 3.

Figure 4:
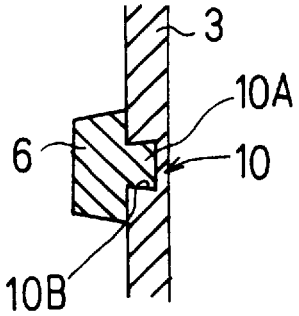
FIG. 4 is a sectional view showing a still another example of the fastening means.

Another example of the fastening means 10 shown in FIG. 4 is not penetrated through the hole(bore, in this example) LOB in the face member 3 to the front side of the face member 3. The projection 10A is dimensioned to be force-fitted into the bore 10B.

Figure 5:
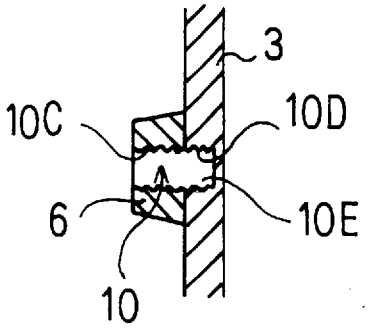
FIG. 5 is a sectional view showing an example in which a screw is used as the fastening means.

FIG. 5 shows a yet another example of the fastening means 10 comprising an internally threaded through-hole 10C formed in the vertical rib 6, an internally threaded bore 10D formed in the face member 3 and a screw 10E. The face member 3 is secured to the vertical rib 6 by driving the screw 10E from the rear side of the vertical rib 6 into the through-hole 10C and then into the bore 10D.

Figure 6:
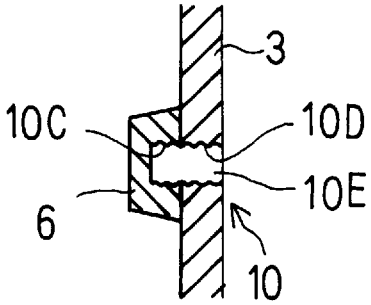
FIG. 6 is a sectional view showing another example in which a screw is used as the fastener.

FIG. 6 shows a further example of the fastening means 10 similar to the example shown in FIG. 5 except that an internally threaded bore 10C is formed in the vertical rib 6 while an internally threaded through-hole 10D is formed in the face member 3. In this example, the screw 10E is driven from the front side of the face member 3 into the internally threaded hole 10D in the face member 3 and then into the internally threaded bore 10C in the vertical rib 6.

Each of the fastening means 10 having been described and illustrated in the above is provided as centered to the face member 3, that is, in the middle of the length of the vertical rib 6. However, similar fastening means to the fastening means 10 may be additionally provided in any place(s) other than the longitudinal center of the vertical rib 6. Namely, the fastening means 10 should be provided in at least the center of the vertical rib 6.

Golf clubheads denoted as a "composite head" have the head body 1 and face member 3 made of different materials, and have been proposed. In such a clubhead, the face member 3 made of a titanium alloy had to be 3.0 to 3.5 mm in thickness. However, the face member 3 which is to be secured to the vertical rib 6 in the longitudinal center of the vertical rib 6 according to the present invention, may be less than 3 mm in thickness. This thickness may be minimized to 2.0 mm which however will not spoil the good feeling of ball hitting impact.

In case different materials are used to make the head body 1 and face member 3, respectively, such are not limited to a use in the aforementioned combination of stainless steel and titanium alloy but the head body 1 may be made of beryllium while the face member 3 may be of duralumin. Any other combination of materials may be adopted to make the head body 1 and face member 3. The clubhead shape of the so-called cavity-back type is not limited only to that shown in FIG. 2. In addition to the vertical rib 6, a horizontal one may be provided on the clubhead.

Figure 7:
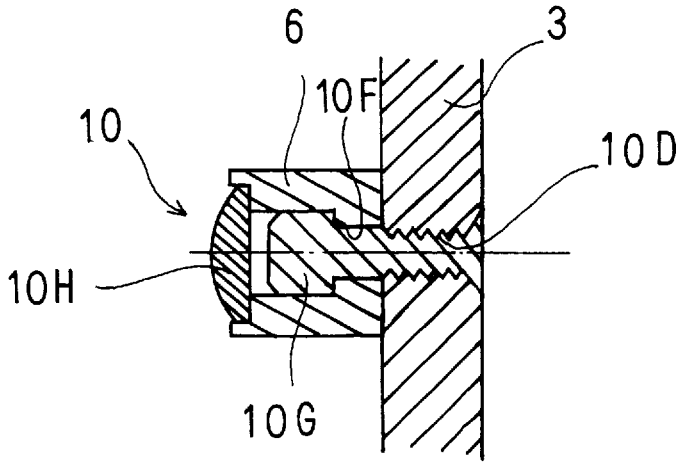
FIG. 7 is a sectional view showing a yet another example of the fastening m leans.
Figure 8:
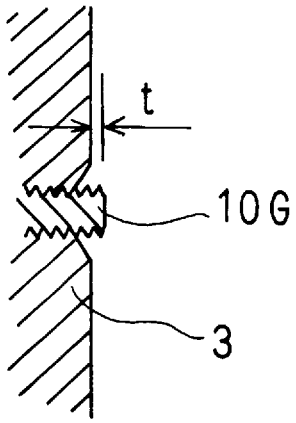
FIG. 8 is a sectional view, enlarged in scale, of the end of the screw as fastening means in FIG. 7.
Figure 9:
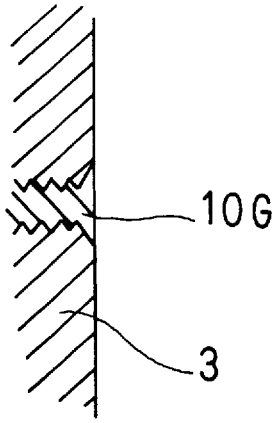
FIG. 9 is a sectional view of the crushed end portion of the screw in FIG.

FIG. 7 shows a still further example of the fastening means 10 in which a stepped through-hole 10F is formed in the vertical rib 6 while an internally threaded through-hole 10D is formed in the face member 3. As shown, the through-hole 10D is countersunk at the front side of the face member 3. A cap 10H is attached in the rear open end of the through-hole 10F in the vertical rib 6. FIG. 8 shows the end of a screw 10G driven through the vertical rib 6 and face member 3. The end of the screw 10G is projected a distance of _t from the front surface of the face member 3. As shown in FIG. 9, the projecting end portion of the screw 10G is crushed so as to be flush with the front surface o the face member 3.

What is claimed is:

1. A golf clubhead comprising; a head body, a face member fitted and secured over an aperture formed in the central area of the head body, a cavity surrounded on a backface of the face member, by a sole, a toe, a heel and a top blade, and a vertical rib provided on the backface of the head body and extending from the top blade to the sole to divide the cavity into a plurality of sections and to support the face member, the head body and vertical rib being integrally formed from metallic materials, respectively;

the vertical rib provided with means for fastening the face member to the vertical rib itself; and said fastening means comprising a bar-shaped projection provided in the longitudinal center of the vertical rib and a hole formed in the center of the face member and in which said projection is force-fitted.

2. A golf clubhead as set forth in claim 1, wherein said hole is a through-hole through which the projection for fastening the face member to the vertical rib penetrates.

3. A golf clubhead as set forth in claim 2, wherein the through-hole is countersunk at a front side of the face member to crush the projection so as to be flush with the front surface of the face member.

4. A golf clubhead comprising; a head body, a face member fitted and secured over an aperture formed in the central area of the head body, a cavity surrounded on a backface of the face member by a sole, a toe, a heel and a top blade, and a vertical rib provided on the backface of the head body and extending from the top blade to the sole to divide the cavity into a plurality of sections and to support the face member, the head body and vertical rib being integrally formed from metallic materials, respectively;

the vertical rib being provided with means for fastening the face member to the vertical rib itself; and said fastening means comprising a screw provided in the longitudinal center of the vertical rib and an internally threaded through-hole provided in the center of the face member and in which the screw is driven.

5. A golf clubhead as set forth in claim 4 wherein said face member is made of a material having a specific gravity less than that of said head body.

6. A golf clubhead as set forth in claim 4, wherein hole is formed in the face member to have a rectangular form corresponding to the projection.

* * * * *